United States Patent [19]

Eberline et al.

[11] 4,093,936

[45] June 6, 1978

[54] LOGGING METHOD AND APPARATUS

[75] Inventors: Howard C. Eberline, Edmond; Jack L. Moon, Oklahoma City, both of Okla.

[73] Assignee: Kerr-McGee Corporation, Oklahoma City, Okla.

[21] Appl. No.: 754,922

[22] Filed: Dec. 27, 1976

[51] Int. Cl.[2] ..... G01V 1/40

[52] U.S. Cl. ..... 340/18 CM; 340/18 R

[58] Field of Search ..... 340/18 CM, 18 P, 18 R, 340/15.5 BH

[56] References Cited

U.S. PATENT DOCUMENTS

| | | | |
|---|---|---|---|
| 3,069,619 | 12/1962 | Lamb | 340/18 CM |
| 3,518,679 | 6/1970 | Baldwin et al. | 340/18 CM |
| 3,707,700 | 12/1972 | Lafont | 340/18 P |
| 3,980,881 | 9/1976 | Veach et al. | 340/18 CM |

*Primary Examiner*—S. C. Buczinski

*Attorney, Agent, or Firm*—William G. Addison

[57] ABSTRACT

A logging method and apparatus for measuring parameters of an earth formation near a borehole wherein a first downhole logging device is connected to a first surface measuring apparatus via a coaxial cable in a first mode of operation of the logging apparatus and wherein a second downhole logging device is connected to a second surface measuring apparatus and to a surface power supply via the coaxial cable in a second mode of operation of the logging apparatus, the second downhole logging device being connected to the coaxial cable in response to the surface power supply being connected to the coaxial cable. In one mode of operation, electrical communication is established between the first downhole logging device and the first surface measuring apparatus and either the positive or the negative terminal of the surface power supply in the first mode of operation of the logging apparatus and, in the second mode of operation of the logging apparatus, electrical communication is established between the second downhole logging device and the second surface measuring apparatus and one of the terminals of the surface power supply, opposite the terminal of the surface power supply connected to the first downhole logging device in the first mode of operation, the logging apparatus being conditioned in the first mode of operation in response to one of the positive and negative terminals of the surface power supply being connected to the coaxial cable and the logging apparatus being conditioned in the second mode of operation in response to the opposite terminal of the surface power supply being connected to the coaxial cable.

12 Claims, 2 Drawing Figures

LOGGING METHOD AND APPARATUS

BACKGROUND OF THE INVENTION

Field of the Invention

The present invention relates generally to logging methods and apparatus and, more particularly, but not by way of limitation, to logging methods and apparatus utilizing more than one downhole logging device wherein at least one of the downhole logging devices requires an electrical operating power supply.

DESCRIPTION OF THE PREFERRED EMBODIMENT

Figure 1:
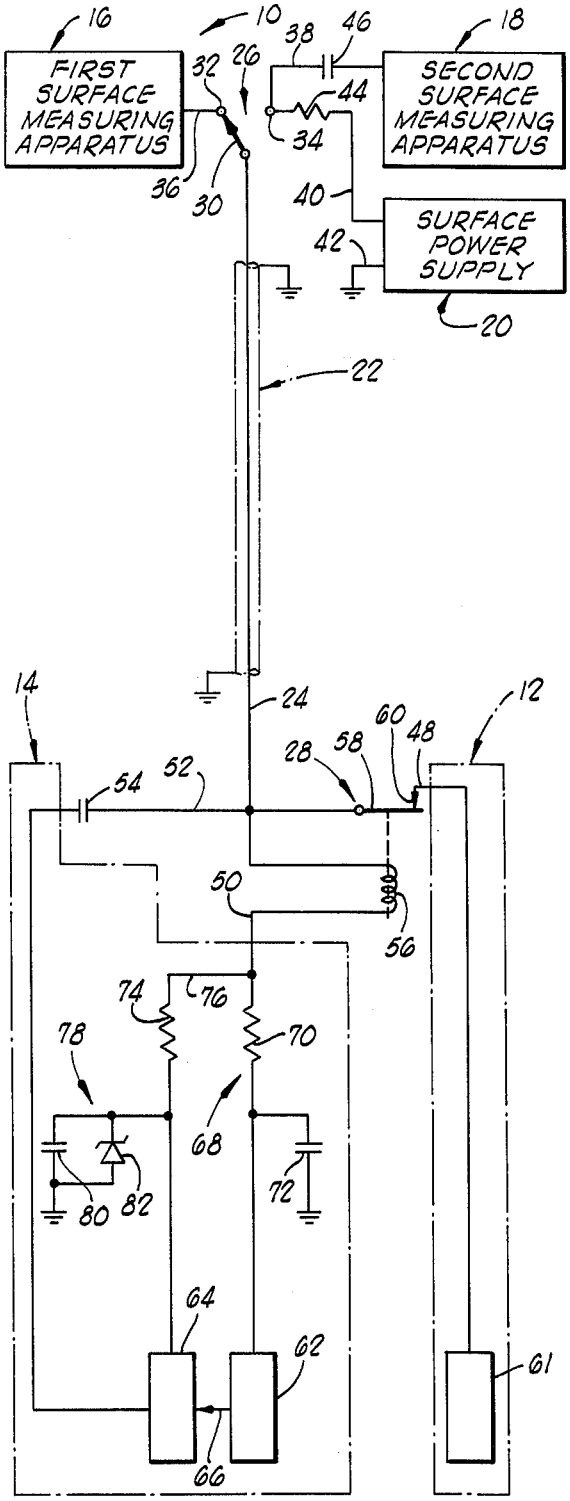
FIG. 1 is a diagrammatic, schematic view of a logging apparatus constructed in accordance with the present invention.

Referring to the drawings in general and to FIG. 1 in particular, shown therein and designated via the general reference numeral 10 is a logging apparatus constructed in accordance with the present invention. In general, the logging apparatus 10 is constructed to determine or measure certain parameters relating to an earth formation generally near a borehole extending from the earth's surface into the earth formation. In general, the logging apparatus 10 includes: a first downhole logging device 12; a second downhole logging device 14; a first surface measuring apparatus 16; a second surface measuring apparatus 18; a surface power supply 20; a coaxial cable 22, having a signal carrying conductor which is schematically shown in FIG. 1 and designated therein via the reference numeral 24; a first switch 26 which is interposed between the coaxial cable 22 and the first and the second surface measuring apparatus 16 and 18 and the surface power supply 20; and a second switch 28 which is interposed between the coaxial cable 22 and the first and the second downhole logging devices 12 and 14.

The logging apparatus 10 of the present invention provides a system capable of providing logging tool responses of a first and a second downhole logging devices 12 and 14 utilizing a single conductor coaxial logging cable. When operating logging tools at relatively large depths (greater than several hundred feet, for example), the spectral qualities of a natural radioactivity type of logging tool (the second downhole logging device 14) are better preserved by transmitting the second signal via a coaxial cable. The tool response (the first signal) of the spontaneous-potential and resistiivity types of logging tools (the first downhole logging device 12) can be transmitted via a single conductor. The addition of a single conductor to a coaxial cable increases the size and weight of the coaxial cable. Thus, it is desirable to limit the coaxial cable to a single conductor, and yet utilize the logging apparatus for simultaneously running the first and the second downhole logging devices 12 and 14, thereby reducing the number of logging runs. Utilizing the logging apparatus 10, the first and the second downhole logging devices 12 and 14 can be run simultaneously utilizing a single conductor coaxial cable.

The first switch 26 has a switch arm 30 which is connected to the conductor 24 of the coaxial cable 22, and a pair of terminals 32 and 34. The terminal 32 of the first switch 26 is connected to the first surface measuring apparatus 16 via a conductor 36, and the terminal 34 of the first switch 26 is connected to the second surface measuring apparatus 16 via a conductor 38. The terminal 34 also is connected to the positive terminal of the surface power supply 20 via a conductor 40 the negative terminal of the surface power supply 20 being connected to ground via a conductor 42.

The first switch 26 has a first position wherein the switch arm 30 is moved to a position contacting the terminal 32 and, in the first position, the first switch 32 operates to establish electrical communication between the first surface measuring apparatus 16 and the conductor 24 of the coaxial cable 22 via the switch arm 30 and the conductor 36, the switch arm 30 being shown in FIG. 1 in the first position. The first switch 26 has a second position (not shown in FIG. 1) wherein the switch arm 30 is moved to a position contacting the terminal 34 and, in this second position, the first switch 32 operates to establish electrical communication between the second surface measuring apparatus 18 and the conductor 24 of the coaxial cable 22 via the switch arm 30 and the conductor 38, the first switch 26 also operating to establish electrical communication between the surface power supply 20 and the conductor 24 of the coaxial cable 22 via the switch arm 30 and the conductor 40 in the second position of the first switch 26.

The surface power supply 20, more particularly, is a direct current type of electrical power supply capable of supplying the necessary operating electrical power to the downhole logging device in electrical communication therewith. In one embodiment (shown in FIG. 1), the surface power supply 20 supplies the operating power supply for the second downhole logging device 14 and, in one other embodiment (shown in FIG. 2), the surface power supply 20 supplies the operating power supply for the first and the second downhole logging devices 14 and 16. In the embodiment of the invention shown in FIGS. 1 and 2, the surface power supply 20 is a relatively high voltage, low impedance, direct current type of electrical power supply, and a resistor 44 is interposed in the conductor 40 between the surface power supply 20 and the first switch 26 for preventing the low impedance of the surface power supply 20 from shunting the pulse signal from the second downhole logging device 14 to ground during the operation of the logging apparatus 10. In one embodiment, the second downhole logging device 14 generates and provides a pulse type of output signal (sometimes referred to herein as the "second signal"), and this pulse signal from the second logging device 14 is coupled to the second surface measuring apparatus 18 through a capacitor 46, which is interposed in the conductor 38 between the second surface measuring apparatus 18 and the first switch 26.

The first downhole logging device 12 generates a first signal representing a parameter indicative of the earth formation near the location of the first downhole logging device 12 in the borehole. The first downhole logging device 12 is connected to the conductor 24 of the coaxial cable 22 via a conductor 48, and the first signal from the first downhole logging device 12 is provided on the conductor 48 and the conductor 24 of the coaxial cable 22, during one aspect of the operation of the logging device 12.

The second downhole logging device 14 is connected to the conductor 24 of the coaxial cable 22 via a conductor 50 and the second downhole logging device 14 also is connected to the conductor 24 of the coaxial cable 22 via a conductor 52. During one mode of the operation of the logging apparatus 10, a power signal is connected to the second downhole logging device 14 via the conductor 50, and the second downhole logging device 14 generates and provides the second signal representing a parameter indicative of the earth formation near the borehole at a position generally near the second downhole logging device 14 in the borehole, the second signal being provided on the conductor 52.

A capacitor 54 is interposed in the conductor 52 generally between the conductor 24 of the coaxial cable 22 and the second downhole logging device 14. The capacitor 52 couples the second signal to the conductor 24 of the coaxial cable 22 and blocks the power signal from being connected to the second downhole logging device 14 via the conductor 52.

The second switch 28 includes a relay coil 56 which is interposed in the conductor 50 generally between the second downhole logging device 14 and the conductor 24 of the coaxial cable 22, and a relay switch arm 58 which is interposed in the conductor 48 generally between the first downhole logging device 12 and the conductor 24 of the coaxial cable 22. The relay coil 56 is operatively connected to the relay switch arm 58 in a manner well known in the art. The second switch 28 has an energized condition and a de-energized condition. More particularly, when the power signal from the surface power supply 20 is connected to the relay coil 56, the relay coil 56 is energized thereby conditioning the second switch 28 in the energized condition and, in the energized condition, the switch arm 58 is moved from contacting engagement with a relay contact 60 thereby interrupting electrical continuity between the first downhole logging device 12 and the conductor 24 of the coaxial cable 22. When the power signal is not applied to the relay coil 56 or, in other words, in the absence of the power signal, the relay coil 56 is de-energized thereby conditioning the second switch 28 in the de-energized condition and, in the de-energized condition (shown in FIG. 1), the relay switch arm 58 is moved into contact with the relay contact 60 thereby establishing electrical continuity between the first downhole logging device 12 and the conductor 24 of the coaxial cable 22 via the conductor 48 and the relay switch arm 58. In other words, the relay switch arm 58 is normally closed and the relay switch arm 58 is opened in response to the power signal being applied to the relay coil 56. It should be noted that the de-energized condition of the second switch 28 is sometimes referred to herein as the first position of the second switch 28 and the energized condition is sometimes referred to herein as the second position of the second switch 28.

In the embodiment of the invention shown in FIG. 1, the first downhole logging device 12, more particularly, is a lithology type of logging tool such as an electrical resistivity type of logging tool or device which includes an electrode 61, such logging tools being commercially available and referred to generally in the art as a "Spontaneous-Potential" logging tool or an "Resistivity Log", for example. The electrode 61 is connected to the conductor 48 and the first signal is provided on the conductor 48, the first signal being received by the first surface measuring apparatus 16 which determines, records and otherwise provides an output indication of the logging tool response provided via the first downhole logging device 12. In general, the resistivity logging tool provides an output signal or, in other words, has a logging tool response indicative of the formation shaliness. Electrical resistivity types of logging tools and the surface apparatus for determining and providing an output indication of the response of such logging tools in a manner as generally described herein with respect to the first downhole logging device 12 and the first surface measuring apparatus 16 are well known in the art and a detailed description of the construction and operation of such apparatus is not deemed necessary herein.

In the embodiment of the invention shown in FIG. 1, the second downhole logging device 14, more particularly, is a radioactive type of logging device which includes a radiation detector 62 and an amplifier 64. Radioactive types of logging tools are commercially available, and the construction and operation of such logging tools including the surface apparatus for determining and providing an output indication of the tool response of such a logging tool (the second downhole logging tool 14 and the second surface measuring apparatus 18) are well known in the art and a detailed description and operation of such apparatus is not deemed necessary herein. It should be noted that in the embodiment of the first and the second downhole logging device 12 and 14 as described, the first and second signals are each generally of the alternating current type of electrical signal.

The radiation detector 62 is connected to the conductor 50 and, during one aspect of the logging apparatus 10, the radiation detector 62 receives an operating power signal via the conductor 50, the radiation detector 62 detecting radioactivity and providing an output signal on a conductor 66 indicative of the detected radioactivity. In one embodiment, the output signal on the conductor 66 is a pulse type of signal and the number of pulses during a given time interval is indicative of the detected radioactivity. The amplifier 64 receives the output signal on the conductor 66 provided via the radiation detector 62 and provides an amplified output signal on the conductor 52, the amplifier 64 output signal being the second signal provided via the second downhole logging device 14.

The radiation detector 62 requires a relatively high voltage, direct-current type of operating power supply which is supplied via the surface power supply 20 during one aspect of the operation of the logging apparatus 10. The amplifier 64 requires a relatively low voltage, direct-current type of operating power supply which also is supplied via the surface power supply 20 in a manner to be described in greater detail below.

A filter 68 is interposed in the conductor 50 between the second switch 28 and the radiation detector 62. The filter 68 comprises a resistor 70 which is interposed in the conductor 50 generally between the relay coil 56 and the radiation detector 62 and a capacitor 72 which is connected to the conductor 50 generally between the resistor 70 and the radiation detector 62, the capacitor 72 also being connected to ground as shown in FIG. 1. The filter 68 filters the relatively high frequency signal components from the power signal on the conductor 50 and the filtered power signal then provides the operating power supply for the radiation detector 62.

A resistor 74 is interposed in a conductor 76 which is connected to the conductor 50 generally between the relay coil 56 and the filter 68. The power signal is applied across the resistor 74 and the resistor 74 operates to drop or lower the voltage level of the power signal to a predetermined voltage level suitable for supplying the operating power supply to the amplifier 64.

A regulator 78 is connected to the conductor 76 generally between the resistor 74 and the amplifier 64. The regulator 78 comprises a capacitor 80 and a Zener diode 82, which are connected in electrical parallel, and the regulator 78 functions to regulate the lowered voltage level power signal which is applied to the amplifier 64 during one aspect of the operation of the logging apparatus 10.

During the operation of the logging apparatus 10, the first and the second downhole logging devices 12 and 14 are each lowered into the borehole and the tool responses provided via the first and the second downhole logging devices 12 and 14 are obtained via the first and the second surface measuring apparatus 16 and 18 at various predetermined positions or depths of the first and the second downhole logging devices 12 and 14 in the borehole. The construction and the technique of running the various logging tools in the borehole including the apparatus and technique for obtaining and plotting or otherwise providing the tool responses of the logging tools are well known in the art.

In a first mode of operation of the logging apparatus 10, the first switch 26 is positioned in the first position (shown in FIG. 1) wherein electrical communication is established between the first surface measuring apparatus 16 and the conductor 24 of the coaxial cable 22 via the switch arm 30 of the first switch 26. In this first mode of operation, the surface power supply 20 is not connected to the conductor 24 of the coaxial cable and thus the relay coil 56 of the second switch 28 is de-energized, thereby conditioning the second switch 28 in the first position (shown in FIG. 1). In the first position of the second switch 28 and in the first mode of operation of the logging apparatus 10, the relay switch arm 58 is closed thereby establishing electrical continunity between the first downhole logging device 12 and conductor 24 of the coaxial cable 22. Thus, in the first mode of operation of the logging apparatus 10, electrical communiction is established between the first downhole logging device 12 and the first surface measuring apparatus 16 via the conductor 24 of the coaxial cable 22 and the first and the second switches 26 and 28. Further, in the first mode of operation, the first downhole logging device 12 provides the first signal on the conductor 48 and the first signal is received via the first surface measuring apparatus 16, the first surface measuring apparatus 16 providing an output indication of the formation parameter represented via the first signal, i.e. an output indication of the tool response of the first downhole logging device 12.

In a second mode of operation of the logging apparatus 10, the first switch 26 is positioned in the second position (not shown in FIG. 1) wherein electrical communication is established between the second surface measuring apparatus 18 and the conductor 24 of the coaxial cable 22 via the switch arm 30 of the first switch 26, electrical communication also being established between the positive terminal of the surface power supply 20 and the conductor 24 of the coaxial cable 22 via the switch arm 30. In this second mode of operation, the surface power supply 20 is in electrical communication with the relay coil 56 of the second switch 28 via the conductor 24 of the coaxial cable 22 and thus the relay coil 56 is energized thereby conditioning the second switch 28 in the second position (not shown in FIG. 2). In the second position of the second switch 28 and in the second mode of operation of the logging apparatus 10, the relay switch arm 58 is opened thereby interrupting electrical continuity between the first downhole logging device 12 and the conductor 24 of the coaxial cable 24. Electrical communication is established between the second downhole logging device 14 and the second surface measuring apparatus 18 and the surface power supply 20 via the conductor 24 of the coaxial cable 22 in this second mode of operation of the logging apparatus 10. More particularly, electrical communication is established between the surface power supply 20 and the radiation detector 62 via the conductor 24 of the coaxial cable 22, the relay coil 56 of the second switch 28 and the filter 68, the surface power supply 20 providing the electrical power supply for operating the radiation detector 62 in the second mode of operation of the logging apparatus 10.

In the second mode of operation of the logging apparatus 10, electrical communication is established between the surface power supply 20 and the amplifier 64 of the second downhole logging apparatus 14 via the conductor 24 of the coaxial cable 22, the relay coil 56 of the second switch 28, the resistor 74 and the regulator 78, the lower voltage level, regulated power signal providing the electrical power supply for operating the amplifier 64. The capacitor 54 blocks the power signal provided via the surface power supply 20 from being connected to the amplifier 64 via the conductor 52 and, since the switch arm 58 is in the opened position, neither the second surface measuring apparatus 18 nor the surface power supply 20 is in electrical communication with the first downhole logging device 12 in the second mode of operation of the logging apparatus 10.

In the second mode of operation of the logging apparatus 10, the radiation detector 62 provides an output signal on the conductor 66 and the signal is amplified via the amplifier 64, the second signal indicative of a formation parameter being provided as the output signal of the amplifier 64 on the conductor 52. The second signal provided via the second downhole logging device 14 is coupled to the conductor 24 of the coaxial cable 22 via the capacitor 54 and the second signal is received via the second surface measuring apparatus 18 in the second mode of operation of the logging apparatus 10, the second surface measuring apparatus 18 providing an output indication of the formation parameter represented via the second signal, i.e. an output indication of the tool response of the second downhole logging device 14.

EMBODIMENT OF FIG. 2

Figure 2:
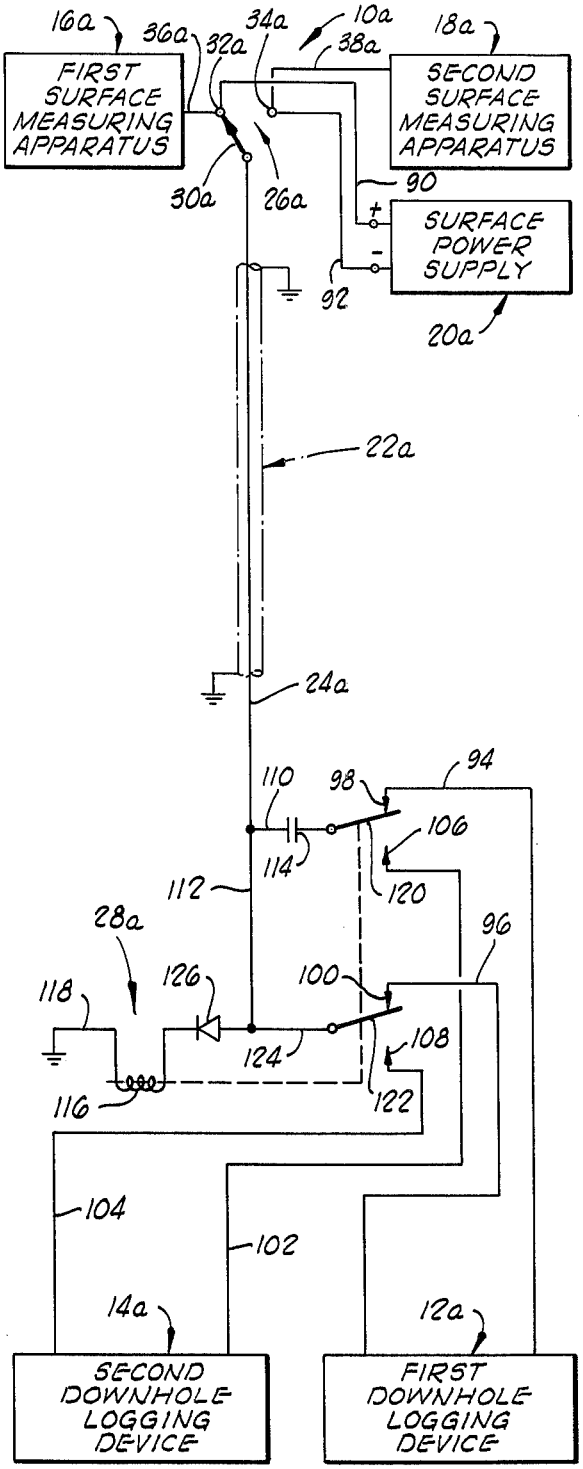
FIG. 2 is a view similar to FIG. 1, but showing a modified logging apparatus.

The modified logging apparatus **10*a*, shown in FIG. 2, is constructed similar to the logging apparatus 10, shown in FIG. 1** and described in detail before.

The positive terminal of the surface power supply **20*a* is connected to the terminal 32*a* of the first switch 26*a* via a conductor 90, and the negative terminal of the surface power supply 20*a* is connected to the terminal 34*a* of the first switch 26*a* via a conductor 92. In this embodiment of the invention (shown in FIG. 2), the first and second downhole logging devices 12*a* and 14*a* each require an electrical, operating power supply and thus the surface power supply 20*a* is connected to the conductor 24*a* of the coaxial cable 22*a* in the first and the second modes of operation of the logging apparatus 10*a*. In the first position of the first switch 26*a* (shown in FIG. 2) the positive terminal of the surface power supply 20a is connected to the conductor 24a of the coaxial cable 22a via the first switch 26a and, in the second position of the first switch 26a, the negative terminal of the surface power supply 20a is connected to the conductor 24a of the coaxial cable 22a**.

The first downhole logging device 12a provides the first signal on a signal path or conductor 94 and receives an electrical operating power supply via a conductor 96. The conductor 94 is connected to the first downhole logging device 12a and to a switch contact 98. The conductor 96 is connected to the first downwhole logging device 12a and to a switch contact 100.

The second downhole logging device 14a provides the second signal on a signal path or conductor 102 and receives an electrical operating power supply via a conductor 104. The conductor 102 is connected to the second downhole logging device 14a and to a switch contact 106, and the conductor 104 is connected to the second downhole logging device 14a and to a switch contact 108.

The switch contacts 98, 100, 106 and 108 each comprise a portion of the second switch 28a. The second switch 28a is connected to the conductor 24a of the coaxial cable 22a via a conductor 110 and via a conductor 112, a capacitor 114 being interposed in the conductor 110 generally between the second switch 28a and the conductor 24a of the coaxial cable 22a. The power signal is connected to the second switch 28a via the conductor 112 and the first and second signals are each selectively connected to the conductor 24a of the coaxial cable 22a via the conductor 110, the capacitor 114 functioning in a manner similar to the capacitor 54 (shown in FIG. 1) to couple the first and the second signals to the coaxial cable 22a and to block the power signal from being connected via the conductor 110 to either the first or the second downhole logging devices 12a or 14a during the operation of the logging apparatus 10a.

The second switch 28a also includes a relay coil 116 interposed in a conductor 118 which is connected to the conductor 24a of the coaxial cable 22a, the conductor 118 also being connected to ground as schematically shown in FIG. 2. The relay coil 116 is operatively connected to a first switch arm 120 and a second switch arm 122, as schematically shown in FIG. 2 and in a manner well known in the art. The first switch arm 120 is connected to the conductor 110 and movable to a first position (shown in FIG. 2) wherein the first switch arm 120 contacts the switch contact 98, the first switch arm 120 also being movable to a second position (not shown in FIG. 2) wherein the first switch arm 120 contacts the switch contact 106. The second switch arm 122 is connected to the conductor 24a of the coaxial cable 22a via a conductor 124 and the second switch arm 122 is movable to a first position (shown in FIG. 2) wherein the second switch arm 122 contacts the switch contact 100, the second switch arm 122 also being movable to a second position (not shown in FIG. 2) wherein the second switch arm 122 contacts the switch contact 108. A diode 126 is interposed between the conductor 24a of the coaxial cable 22a and the relay coil 126.

The second switch 28a has a first position (sometimes referred to herein as an energized condition) wherein the positive terminal of the surface power supply 20a is connected to the second switch 28a via the conductor 24a of the coaxial cable 22a and, in this condition, the diode 126 passes the power signal applied to the conductors 24a and 112. The power signal passed through the diode 126 energizes the relay coil 116. In the energized condition of the relay coil 116, the first and the second switch arms 120 and 122 are each moved to the first position (shown in FIG. 2) contacting the switch contacts 98 and 100, respectively.

The second switch 28a has a second position (sometimes referred to herein as a de-energized condition) wherein the negative terminal of the surface power supply 20a is connected to the second switch 28a via the conductor 24a of the coaxial cable 22a and, in this condition, the diode 126 blocks the power signal applied to the conductors 24a and 112. In the de-energized condition of the relay coil 116, the first and the second switch arms 120 and 122 are each moved to the second position (not shown in FIG. 2) contacting the switch contacts 106 and 108, respectively.

In the first mode of operation of the logging apparatus 10a, the first switch 26a is moved to the first position (shown in FIG. 2) wherein electrical communication is established between the first surface measuring apparatus 16a and the conductor 24a of the coaxial cable 22a and wherein electrical communication is established between the positive terminal of the surface power supply 20a and the conductor 24a of the coaxial cable 22a. In this first mode of operation, the diode 126 passes the power signal provided at the positive terminal of the surface power supply 20a, and the power signal operates to energize the relay coil 116, thereby conditioning the second switch 28a in the first position (shown in FIG. 1). In the first position of the second switch 28a and in the first mode of operation of the logging apparatus 10a, electrical communication is established between the first surface measuring apparatus 16a and the first downhole logging device 12a via the first switch 26a, the conductor 24a of the coaxial cable 22a, the second switch 28a and the conductor 94, the first signal being provided via the first downhole logging device 12a and received via the first surface measuring apparatus 16a in a manner and for reasons similar to that described before with respect to the embodiment of the invention shown in FIG. 1. Further, in the first mode of operation of the logging apparatus 10a, the positive terminal of the surface power supply 20a is in electrical communication with the first downhole logging device 12a via the conductor 90, the first switch 26a, the conductor 24a of the coaxial cable 22a, the second switch 28a and the conductor 96, the surface power supply 20a providing the electrical operating power supply for the first downhole logging device 12a.

In the second mode of operation of the logging apparatus 10a, the first switch 26a is positioned in the second position (not shown in FIG. 2) wherein electrical communication is established between the second surface measuring apparatus 18a and the conductor 24a of the coaxial cable 22a and wherein electrical communication is established between the negative terminal of the surface power supply 20a and the conductor 24a of the coaxial cable 22a. In this second mode of operation, the diode 126 blocks the power signal provided at the negative terminal of the surface power supply 20a and the relay coil 116 is in a de-energized condition, thereby conditioning the second switch 28a in the second position (not shown in FIG. 2). In the second position of the second switch 28a and in the second mode of operation of the logging apparatus 10a, electrical communication is established between the second surface measuring apparatus 18a and the second downhole logging device 14*a* via the first switch 26*a*, the conductor 24*a* of the coaxial cable 22*a*, the second switch 28*a* and the conductor 102, the second signal being provided via the second downhole logging device 14*a* and received via the second surface measuring apparatus 18*a* in a manner and for reasons similar to that described before with respect to the embodiment shown in FIG. 2. Further, in the second mode of operation of the logging apparatus 10*a*, the negative terminal of the surface power supply 20*a* is in electrical communication with the second downhole logging device 14*a* via the conductor 92, the first switch 26*a*, the conductor 24*a* of the coaxial cable 22*a*, the second switch 28*a* and the conductor 104, the surface power supply 20*a* providing the electrical operating power supply for the second downhole logging device 14*a*.

Thus, in the embodiment of the invention shown in FIG. 2, both the first and the second downhole logging devices 12*a* and 14*a* require an electrical operating power supply and the second switch 28*a* is conditioned in the first and the second position in response to the polarity of the power signal provided via the surface power supply 20*a*. However, the first and the second downhole logging devices 12*a* and 14*a* are selectively connected to the first and the second surface measuring apparatus 16*a* and 18*a* in a manner permitting the utilization of a single conductor type of coaxial cable in a manner and for reasons described before with respect to FIG. 1.

Changes may be made in the construction and the operation of the logging apparatus and in the method described herein without departing from the spirit and the scope of the invention as defined in the following claims.

What is claimed is:

1. A logging apparatus for measuring parameters relating to an earth formation near a borehole extending from the earth's surface into the earth formation comprising:

a first downhole logging device generating a first signal representing a parameter indicative of the earth formation near the borehole in a first mode of operation of the logging apparatus;

a coaxial cable connectable to the first downhole logging device in the first mode of operation of the logging apparatus;

a first surface measuring apparatus connected to the coaxial cable in the first mode of operation of the logging apparatus and receiving the first signal when connected to the first downhole logging device via the coaxial cable in the first mode of operation of the logging apparatus;

a surface power supply connected to the coaxial cable and providing a power signal in a second mode of operation of the logging apparatus;

a second downhole logging device connected to the coaxial cable and connected to the surface power supply via the coaxial cable in the second mode of operation of the logging apparatus, the second downhole logging device generating a second signal representing a parameter indicative of the earth formation when connected to the surface power supply via the coaxial cable in the second mode of operation of the logging apparatus;

a second surface measuring apparatus connected to the coaxial cable in the second mode of operation of the logging apparatus and receiving the second signal when connected to the second downhole logging device via the coaxial cable in the second mode of operation of the logging apparatus;

a first switch connected to the coaxial cable, the first surface measuring apparatus and the second surface measuring apparatus, the first switch having a first position establishing electrical communication between the first surface measuring apparatus and the coaxial cable in the first mode of operation of the logging apparatus and a second position establishing electrical communication between the second surface measuring apparatus, the surface power supply and the coaxial cable in the second mode of operation of the logging apparatus; and, a second switch connected to coaxial cable, the first downhole logging apparatus and the second downhole logging apparatus, the second switch having a first position establishing electrical communication between the coaxial cable and the first downhole logging device and a second position establishing electrical communication between the coaxial cable and the second downhole logging device, the second switch being positioned in the second position in response to the power signal provided via the surface power supply in the second mode of operation of the logging apparatus and the second switch being positioned in the first position in the first mode of operation of the logging apparatus.

2. The logging apparatus of claim 1 wherein the surface power supply is defined futher as providing a direct current power signal.

3. The logging apparatus of claim 2 wherein the first and the second signals are each defined further as being alternating current signals.

4. The logging apparatus of claim 1 wherein the second downhole logging device is defined further to include:

a radiation detector for detecting radioactivity, the radiation detector receiving the power signal provided via the surface power supply and providing a signal indicative of the detected radioactivity in the second mode of operation of the logging apparatus, the power signal providing the operating power supply for the radiation detector; and an amplifier receiving the signal provided via the radiation detector and providing an amplified output signal indicative of detected radiation, the amplifier output signal being the second signal provided via the second downhole logging device.

5. The logging apparatus of claim 4 wherein the second downhole logging device is defined further to include:

a filter interposed between the second switch and the radiation detector for filtering relatively high frequency signal components from the power signal, the filtered power signal providing the operating power supply for the radiation detector.

6. The logging apparatus of claim 5 defined further to include:

means interposed between the second switch and the amplifier for lowering the voltage level of the power signal to a predetermined level; and means interposed between the amplifier and the means for lowering the voltage level of the power signal for regulating the lower voltage level power signal, the regulated lower voltage level power signal providing the operating power supply for the amplifier.

7. The logging apparatus of claim 6 defined further to include:

a capacitor interposed between the amplifier and the coaxial cable for coupling the second signal to the coaxial cable.

8. The logging apparatus of claim 1 wherein the second switch is defined further to include:

a relay coil, having an energized condition and a de-energized condition, interposed between the coaxial cable and the second downhole logging device, the relay coil being in the energized condition when receiving the power signal in the second mode of operation of the logging apparatus; and a relay contact arm connected to the coaxial cable and operatively connected to the relay coil, having a first position establishing electrical continuity between the coaxial cable and the first downhole logging device and a second position interrupting electrical continuity between the coaxial cable and the first downhole logging device.

9. The logging apparatus of claim 2 wherein the surface power supply has an electrically positive terminal and an electrically negative terminal; and wherein the first switch establishes electrical continuity between the first surface measuring apparatus and one of the positive and the negative terminals of the surface power supply and the coaxial cable in the first position of the first switch and in the first mode of operation of the logging apparatus; and wherein in the second mode of operation of the logging apparatus the first switch establishes electrical continuity between the coaxial cable and the second surface measuring apparatus and one of the positive and the negative terminals of the surface power supply, opposite to one of the positive and the negative terminals in electrical continuity with the coaxial cable in the first mode of operation of the logging apparatus; and wherein the second switch is defined further as being positioned in the first position and establishing electrical continuity between the first downhole logging device and the coaxial cable in the first mode of operation and in response to the one of the positive and the negative terminals of the surface power supply being connected to the coaxial cable in the first position of the first switch, electrical continuity being established between the first downhole logging device and the first surface measuring apparatus and the one of the positive and the negative terminals of the surface power supply in electrical continuity with the coaxial cable in the first mode of operation of the logging apparatus; and wherein the second switch is defined further as being positioned in the second position and establishing electrical continuity between the second downhole logging device and the coaxial cable in the second mode of operation and in response to the opposite one of the positive and the negative terminals of the surface power supply, opposite the terminal of the surface power supply in electrical continuity with the coaxial cable in the first mode of operation, being connected to the coaxial cable in the second position of the first switch, electrical continuity being established between the second downhole logging device and the second surface measuring apparatus and the opposite one of the positive and the negative terminals of the surface power supply in electrical continuity with the coaxial cable in the second mode of operation of the logging apparatus.

10. A logging method utilizing a first downhole logging device, a second downhole logging device, a first surface measuring apparatus, a second measuring apparatus, a surface power supply and a coaxial cable, comprising the steps of:

establishing electrical continuity between the coaxial cable and the first surface measuring apparatus in a first mode of operation;

establishing electrical continuity between the first downhole logging device and the coaxial cable in the first mode of operation, electrical continuity being thereby established between the first surface measuring apparatus and the first downhole logging device via the coaxial cable in the first mode of operation;

establishing electrical continuity between the second surface measuring apparatus and the coaxial cable and about simultaneously interrupting electrical communication between the first surface measuring apparatus and the coaxial cable in a second mode of operation;

establishing electrical continuity between the surface power supply and the coaxial cable in the second mode of operation; and establishing electrical continuity between the second downhole logging device and the coaxial cable in response to electrical continuity being established between the surface power supply and the coaxial cable, thereby establishing electrical continuity between the second surface measuring apparatus, the surface power supply and the second downhole logging device in the second mode of operation.

11. The method of claim 10 defined further to include the steps of:

interrupting electrical continuity between the surface power supply and the coaxial cable; and interrupting electrical continuity between the second downhole measuring apparatus and the coaxial cable in response to electrical continuity being interrupted between the surface power supply and the coaxial cable.

12. The method of claim 10 wherein the surface power supply has a positive terminal and a negative terminal, and wherein the method is defined further to include the step of:

establishing electrical continuity between one of the positive and the negative terminals of the surface power supply in the first mode of operation; and wherein the step of establishing electrical continuity between the first downhole logging device and the coaxial cable is defined further as establishing electrical continuity between the first downhole logging device and the coaxial cable in response to electrical continuity being established between the coaxial cable and one of the positive and the negative terminals of the surface power supply; and wherein the step of establishing electrical continuity between the surface power supply and the coaxial cable in the second mode of operation is defined further as establishing electrical continuity between the coaxial cable and the opposite one of the positive and the negative terminals of the surface power supply, opposite the one of the positive and the negative terminals in electrical communication with the coaxial cable in the first mode of operation, in response to electrical continuity being established between the coaxial cable and the opposite one of the positive and the negative terminals of the surface power supply, opposite the one of the positive and the negative terminals of the surface power supply in electrical communication with the coaxial cable in the first mode of operation.

* * * * *